United States Patent [19]

Evans

[11] Patent Number: 4,807,590

[45] Date of Patent: Feb. 28, 1989

[54] FIREPLACE VACUUM SYSTEM

[76] Inventor: Wendell K. Evans, 5313 Athena Dr., Savannah, Ga. 31404

[21] Appl. No.: 168,800

[22] Filed: Mar. 16, 1988

[51] Int. Cl.[4] ..... F23J 1/00

[52] U.S. Cl. ..... 126/242; 110/165 R; 15/319

[58] Field of Search ..... 126/242, 243, 244; 110/165 R, 166, 167; 15/319

[56] References Cited

U.S. PATENT DOCUMENTS

| | | | |
|---|---|---|---|
| 1,611,018 | 12/1926 | Fuller | 126/242 |
| 1,887,768 | 11/1932 | Maloney | 126/242 |
| 2,234,788 | 9/1939 | Williams | 126/242 |
| 3,409,002 | 11/1968 | Vackar | 126/242 |
| 3,416,514 | 12/1968 | Klemme | 126/242 |
| 3,510,904 | 5/1970 | Lagerstrom | 15/319 |

*Primary Examiner*—Margaret A. Focarino
*Assistant Examiner*—Denise L. Ferensic
*Attorney, Agent, or Firm*—David H. Semmes

[57] ABSTRACT

Fireplace vacuum system, particularly a system for removal of ashes from the fireplace hearth to a remote location. The system includes an ash collection box mounted within the fireplace hearth, a wheeled vacuum unit mounted apart from the fireplace and a flexible suction pipe or tube interconnecting the ash collection box and the vacuum unit. The unit is characterized by its simplicity, ease of installation and effectiveness in safely removing fireplace ash.

4 Claims, 2 Drawing Sheets

FIREPLACE VACUUM SYSTEM

BACKGROUND OF THE INVENTION (1) Field of the Invention

Fireplace vacuum systems for the removal of ash from the fireplace hearth.

(2) Citation of the Prior Art

Fuller, U.S. Pat. No. 1,611,018
Maloney, U.S. Pat. No. 1,887,768
Williams, U.S. Pat. No. 2,234,788
Vackar, U.S. Pat. No. 3,409,002
Klemme, U.S. Pat. No. 3,416,514

SUMMARY OF THE INVENTION

A fireplace vacuum system of the type including an ash collection box mounted within the fireplace hearth, a wheeled vacuum unit mounted apart from the fireplace and a flexible suction pipe or tube interconnecting the ash collection box and the vacuum unit. The unit is charcterized by its simplicity, ease of installation and a thermocouple control which prevents activation of the vacuum in the event that the temperature of the fireplace ashes exceeds 100° F.

DESCRIPTION OF THE PREFERRED EMBODIMENTS

Figure 1:
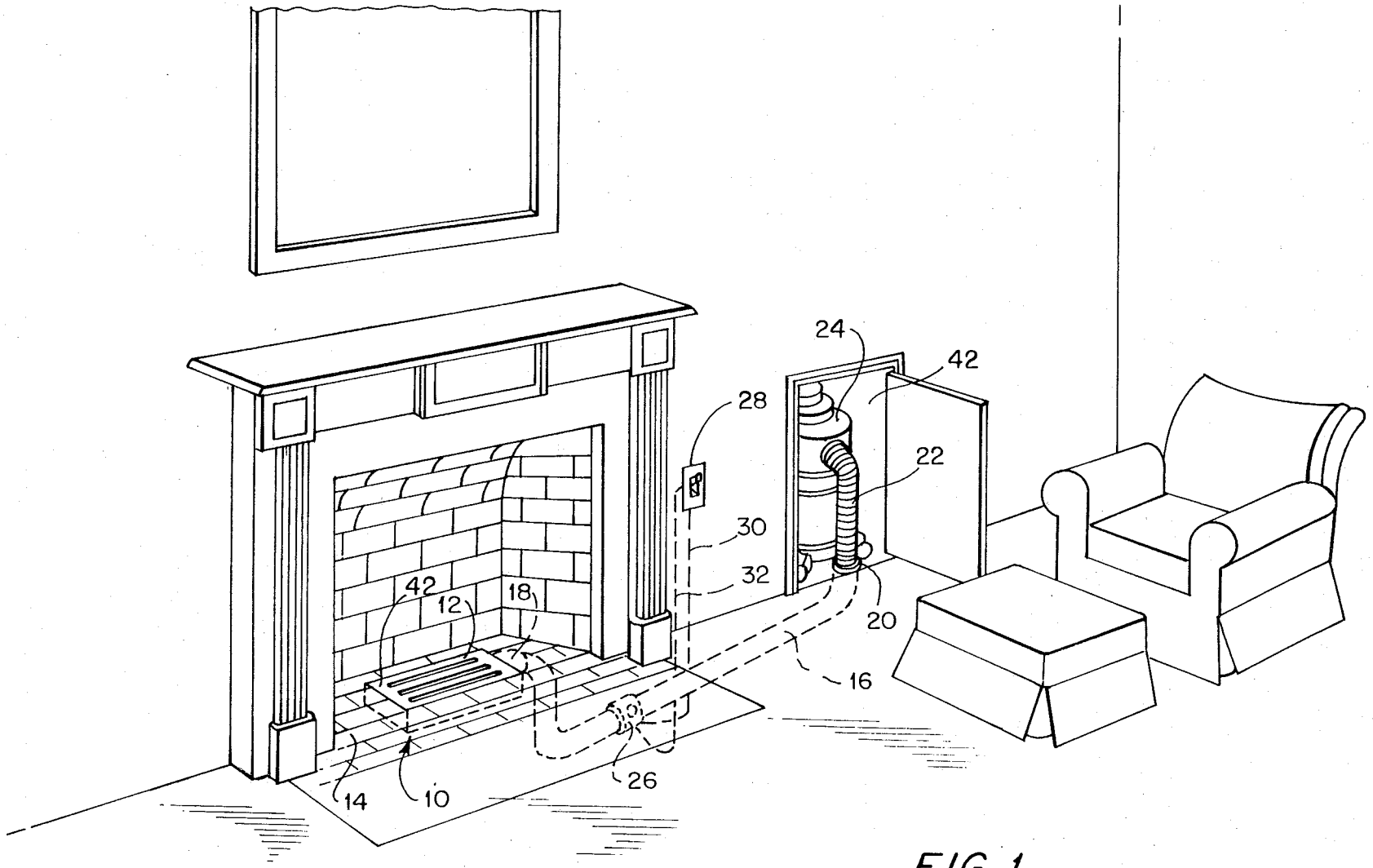
FIG. 1 is a fragmentary perspective view, showing the fireplace vacuum system installed within a household fireplace and a wheeled vacuum mounted in an adjacent wall closet.
Figure 2:
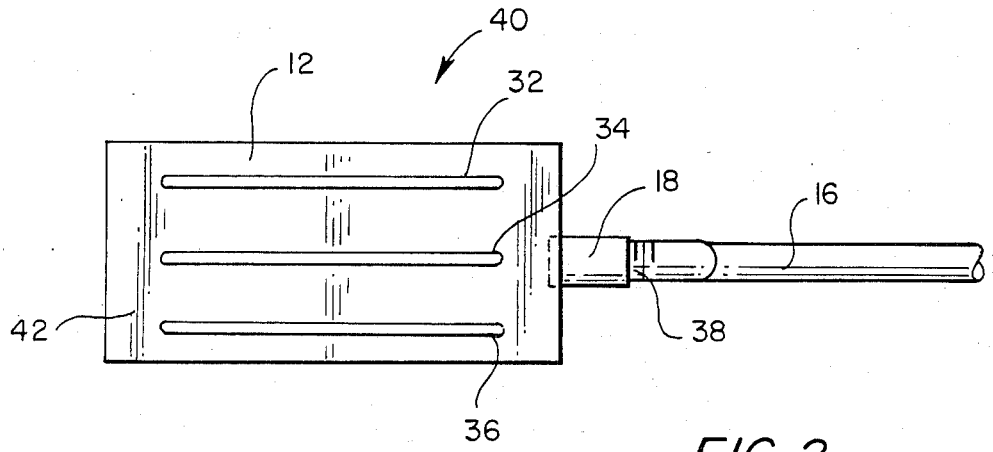
FIG. 2 is an enlarged top plan of the ash collection box.
Figure 3:
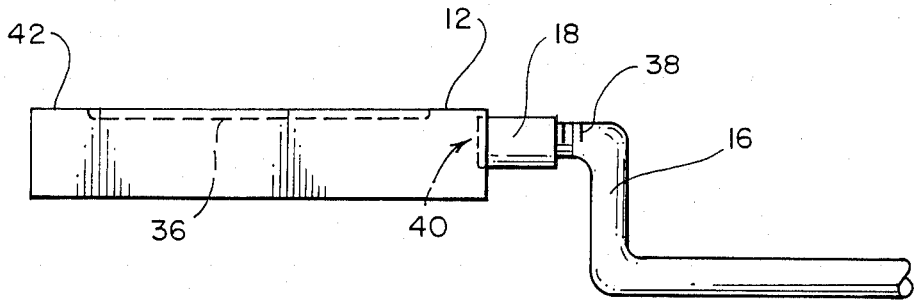
FIG. 3 is a side elevation of the ash collection box.
Figure 4:
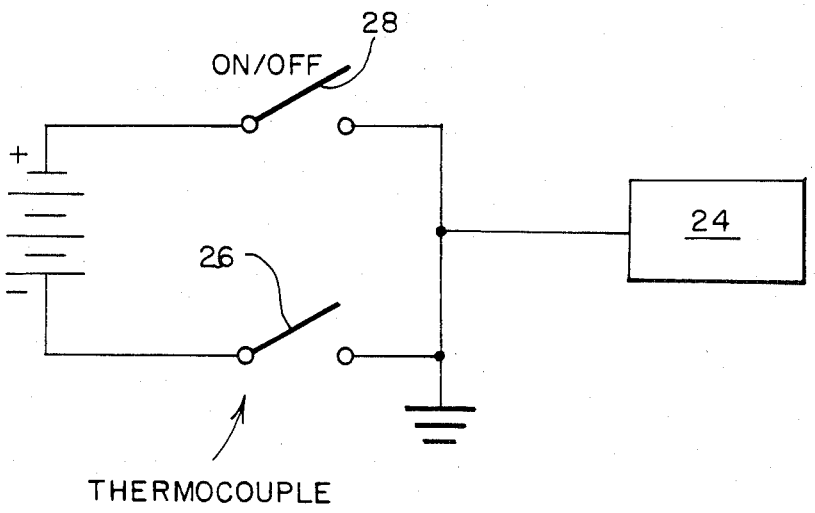
FIG. 4 is a circuit diagram detailing the on/off switch and thermocouple safety switch.

In FIG. 1, there is illustrated applicant's fire vacuum system 10 designed for removal of ashes from the home fireplace. The system may be installed easily in new or existing homes without the necessity for removal of bricks by simply locating and drilling a hole in the hearth, then adding one layer of brick so as to enclose the ash collection box 12.

Applicant's fire vacuum is designed primarily to do away with the task of cleaning ashes from home fireplace systems with the resultant spills, mess and aggravation. Applicant's simple design assures that ashes fall on or near the suction vents and that only ashes or particles smaller than ¼ inch diameter are drawn into the vacuum system. An eight gallon industrial vacuum 24 that powers the system is also portable and detachable from the fire vacuum system and can double as a shop vacuum, or a home vacuum cleaning system.

Applicant's fire vacuum system 10 is composed of three main parts; the fireplace unit 20, the flexible suction pipe 16, and the eight gallon industrial vacuum 24, which is the heart of the system.

Fireplace unit 10 is primarily a rectangular box 12 constructed of ¼ steel plate. Suggested dimensions of box 12 are length 13 inches, width 8 inches, and height 2 inches. Box 12 will have three vacuum slots 32, 34 and 36 cut into the top 42, each slot being approximately eight inches long and ¼ inch wide, the three slots being evenly spaced apart across top 12. In addition, box 12 includes an interior screen 40 secured across discharge coupling 18 to preclude the vacuum discharge of long, narrow objects which may fall lengthwise through the slots and into suction pipe 16. Screen 40 may be ¼ inch mesh or smaller. Tube 16 may be secured to coupling 18 by means of threads 38.

The second part of applicant's fire vacuum is the flexible suction pipe or tube 16, which may run through the hearth, underneath the floor and through the house exterior wall, if there is a slab foundation. Suction pipe 16, as in the case of fireplace unit 12, is completely fireproof. In FIG. 1, suction pipe 16 is illustrated as extending beneath the living room floor, then upwardly through the floor into a coupling 20 with vacuum unit tube 22. In this mode, vacuum unit 24 is portably confined within a wall closet 42.

The third part of applicant's fire vacuum system is illustrated in the form of the eight gallon portable industrial vacuum 24 including flexible coupling hose 22. Vacuum 24 may be located virtually anywhere in the interior or exterior of the home and will not lose its powerful suction. As such, vacuum 24 is easily accessible and inexpensive to replace or repair. Vacuum 24 may also be detached from the rest of the fire vacuum system and used independently for a variety of household purposes.

It is respectfully submitted that applicant's system is more efficient and ultimately more reliable than earlier fireplace vacuum systems, and far less costly. In addition, applicant's fire vacuum system can be actuated by a wall mounted or remote on/off switch 28, defined in circuit wires 30, 32, and automatically overridden by thermocouple safety switch 26 which will prevent activation of vacuum unit 24 if the ashes are over 100° F. in temperature.

Manifestly, variations in ash collection box, flexible tube and the vacuum unit may be employed without departing from the spirit of invention.

I claim:

1. Fireplace vacuum system for the removal of ashes from a fireplace hearth, comprising:

(a) a fireplace ash collection box supportable upon the fireplace hearth, and further including:
  (i) at least one vacuum slot defined in its top,
  (ii) a vacuum discharge coupling extending outwardly at one end of the box, and
  (iii) a screen mounted upon an end of said vacuum discharge coupling within said ash collection box so as to cover said vacuum discharge coupling;

(b) a suction pipe secured at one end to said vacuum discharge coupling and extending away from the said collection box and beneath the hearth;

(c) a vacuum unit positioned apart from the fireplace and connected to the other end of said suction pipe, so as to remove fireplace ashes from said ash collection box and via said suction pipe; and (d) an electrical control system for said vacuum unit including a source of power, an on/off switch and a thermocouple safety switch, positioned within said suction pipe.

2. A fireplace vacuum system for the removal of ashes from a fireplace hearth as in claim 1, said on/off switch being mounted in the form of a wall-mounted unit.

3. A fireplace vacuum system for the removal of ashes from a fireplace hearth as in claim 2, said vacuum being supported within a wall closet adjacent the fireplace with a vacuum tube extending through the house floor to a coupling with said vacuum unit.

4. A fireplace vacuum system as in claim 1, said thermocouple safety switch being set to prevent activation of said vacuum unit, except as the temperature of the fireplace ashes is less than 100° F.

* * * * *